United States Patent [19]

Eckert et al.

[11] 4,041,921

[45] Aug. 16, 1977

[54] FUEL INJECTION PUMP FOR INTERNAL COMBUSTION ENGINES

[75] Inventors: Konrad Eckert; Franz Eheim, both of Stuttgart, Germany

[73] Assignee: Robert Bosch GmbH, Stuttgart, Germany

[21] Appl. No.: 709,071

[22] Filed: July 27, 1976

Related U.S. Application Data

[63] Continuation of Ser. No. 531,293, Dec. 10, 1974, abandoned.

[30] Foreign Application Priority Data

Dec. 13, 1973 Germany ..... 2361958

[51] Int. Cl.[2] ..... F02M 39/00; F02D 1/04

[52] U.S. Cl. ..... 123/140 R; 123/139 BD; 123/139 R

[58] Field of Search ..... 123/140 R, 139 BD, 139 R

[56] References Cited

U.S. PATENT DOCUMENTS

| | | | |
|---|---|---|---|
| 2,869,529 | 1/1959 | Oxenfart et al. | 123/139 R |
| 3,024,779 | 3/1962 | Hogeman | 123/139 BD |
| 3,791,361 | 2/1974 | Hofmann | 123/139 BD |

*Primary Examiner*—Carroll B. Dority, Jr.
*Assistant Examiner*—Ronald B. Cox
*Attorney, Agent, or Firm*—Edwin E. Greigg

[57] ABSTRACT

A fuel injection pump with a simultaneously rotating and reciprocating fuel delivery piston and with rpm-dependent fuel quantity control exerted by a centrifugal force governor. The fuel delivery piston is powered by a primary shaft which also drives a secondary shaft of the governor through gears. The governor shaft powers a concentric fuel pump which supplies rpm-dependently pressurized fuel to the fuel delivery piston.

4 Claims, 2 Drawing Figures

FUEL INJECTION PUMP FOR INTERNAL COMBUSTION ENGINES

This is a continuation, of application Ser. No. 531,293, filed Dec. 10, 1974 now abandoned.

BACKGROUND OF THE INVENTION

The invention relates to a fuel injection pump for internal combustion engines including a pump piston for delivering fuel. The piston is caused to perform simultaneous rotating and reciprocating motion by a cam plate which is driven by a primary power shaft. The quantity of delivered fuel can be changed by a supply quantity control member which is actuated by a centrifugal force governor. The governor is also driven by the primary shaft and acts in opposition to restoring forces. The fuel injection pump also includes a fuel supply pump.

In known fuel injection pumps of the type described above, the fuel supply pump is embodied as a vane pump, whose inner driven member is powered by the primary drive shaft of the injection pump and is disposed axially thereof.

Thus, the fuel supply pump of these fuel injection pumps is driven at the injection pump rpm. The drive shaft cannot, however, be made arbitrarily heavy, because this would result in an excessively large fuel supply pump, and would especially affect the radial extent thereof. However, a drive shaft having a smaller diameter does not have sufficient torsional strength so that torsional oscillations may occur which are detrimental to the operation of the centrifugal force governor driven by this shaft.

OBJECT AND SUMMARY OF THE INVENTION

It is the principal object of the invention to provide a fuel injection pump in which the above-described disadvantages are overcome and wherein, especially, the fuel supply pump has small dimensions while maintaining the same volume rate so that it may be located favorably and in space-saving manner within the pump housing.

This object is attained, according to the invention, in that the shaft of the centrifugal force governor is powered by the primary drive shaft of the fuel injection pump, and in turn, drives both the centrifugal weights and the fuel supply pump.

This disposition of the fuel supply pump imparts the advantage that it may be driven through gears and may be made very small when its required volume rate is small. The construction according to the invention is possible without great expense because the fuel supply pump is built onto the centrifugal force governor which is already present in the fuel injection pump. Furthermore, the drive shaft may have a substantially larger diameter without an attendant increase of the dimensions of the fuel injection pump.

Thus, the drive shaft becomes considerably more rigid so that any torsional oscillations transmitted to the centrifugal force governor driven by this drive shaft are very small.

Furthermore, coupling the centrifugal force governor to the fuel supply pump results in additional damping.

Another feature of the invention provides that the fuel supply pump is disposed in a recess of the fuel injection pump housing which is closed by a cover and that the driven member of the fuel supply pump is mounted axially on one end of the governor shaft. Mounting the fuel supply pump on the shaft of the centrifugal force governor secures it axially in a favorable manner.

The invention will be better understood as well as further objects and advantages become more apparent from the ensuing detailed specification of an exemplary embodiment taken in conjunction with the drawing.

DESCRIPTION OF THE PREFERRED EMBODIMENT

Figures 1, 2:
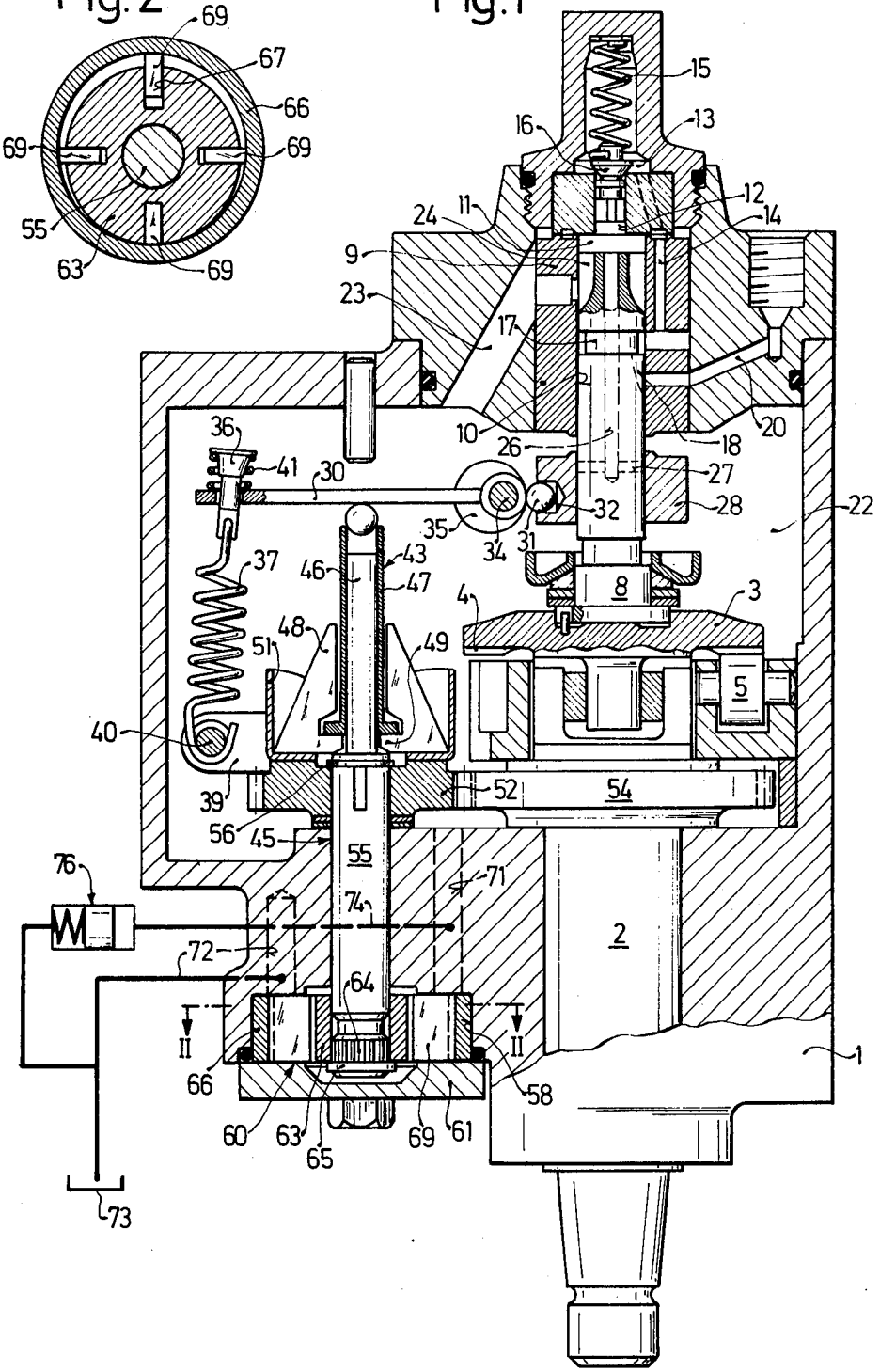
FIG. 1 is a partial section through a fuel injection pump including a centrifugal force governor powered by a primary drive shaft and showing the fuel supply pump provided according to the invention.
FIG. 2 is a section through the fuel supply pump of this exemplary embodiment on lines II—II of FIG. 1.

The housing 1 of a fuel injection pump for multi-cylinder internal combustion engines includes a primary drive shaft 2 mounted therein. This drive shaft is coupled to a frontal cam plate 3 provided with a plurality of cam lobes 4 equal in number to the number of cylinders of an internal combustion engine to be supplied with fuel. During rotation of the primary drive shaft, the cam lobes 4 are lifted by locally fixed rollers 5. This lifting action causes a pump piston 8, coupled to the frontal cam plate 3 and pressed thereon by a spring (not shown) to perform simultaneous reciprocating and rotating motions.

The pump piston 8 moves within a cylinder bushing 9 with a central bore 10 which is inserted in the housing 1, and which is closed on top. The piston 8 and the bore 10 define a working chamber 11. The working chamber 11 communicates through an axial bore 12 with a chamber 13 which in turn, communicates through a line 14 with the bore 10 in the cylinder bushing 9. The axial bore 12 may be closed off by a valve member 16 loaded in the direction of the working chamber 11 by a spring 15. The connecting line 14 terminates radially in the cylinder bore 10. The pump piston has an annular external groove 17 which communicates with a longitudinal groove 18. During each pressure stroke of the pump piston, and depending on the rotational motion of the piston, a sequential communication is established between the connecting line 14 and one of the individual pressure lines 20 terminating in the bore 10. The pressure lines 20 are distributed uniformly about the cylinder bore, there being as many pressure lines as there are cylinders to be supplied with fuel and they lead to the injection valves (not shown) of the internal combustion engine.

During each pressure stroke of the pump piston 8, fuel is supplied to the axial bore 12 where it lifts the valve member 16, and flows through the chamber 13, the connecting line 14 and the distribution groove 18 to one of the pressure lines 20. During the suction stroke of the pump piston on the other hand, fuel flows from a pump suction chamber 22 through a supply line 23 terminating in the bore 10 and through one of several longitudinal grooves 24 provided on the outer surface of the pump piston and flows into the working chamber 11. The number of grooves 24 equals the number of pressure lines 20. During the pressure stroke, the piston rotates and interrupts communication between the supply line 23 and the longitudinal grooves 24 so that the full fuel quantity moved by the piston may be delivered to one of the pressure lines 20.

For the purpose of controlling the quantity of delivered fuel, a transverse bore 27 and an intersecting axial blind bore 26 within the pump piston 8 may create a communication between the working chamber 11 and the suction chamber 22. A fuel quantity control member embodied as an annular slide 28, glides concentrically on the piston 8 and cooperates with the transverse bore 27 in the manner of a valve. Its position on the piston determines the point during the upward stroke of the pump piston 8 at which the transverse bore 27 is opened by the annular slide and a communication is created between the working chamber 11 and the pump suction chamber 22. From this point on, the pumped delivery of fuel to the pressure lines 20 is interrupted. Thus, the setting of the annular valve slide 28 can be used to adjust the injected fuel quantity, in the following manner:

The annular valve slide 28 is moved by a control lever 30 which has a spherical head 31 that engages a recess 32 in the slide 28. The control lever is pivotable about an axis 34 located on an adjustable, eccentric housing insert 35. The other end of the control lever 30 is associated with a bolt 36 to which a control spring 37 is attached.

The other end of the control spring 37 is hooked onto a stud 40 affixed to an operating lever 39. The operating lever permits setting the basic tension of the control spring 37. An idler spring 41 is placed on the bolt 36 between the control lever 30.

A centrifugal force governor 43 engages the control lever 30 at a point lying between the point of affixation of the control spring 37 and the pivotal axis 34 of the control lever. The centrifugal force governor 43 comprises a secondary shaft 45 whose upper portion 46 has a reduced diameter and carries a sliding control sleeve 47 provided with a spherical tip. The control sleeve is slidingly moved by flyweights 48 whose projections 49 engage the control sleeve 47. The flyweights are located within sheet metal pockets 51 fixedly attached to a gear 52 mounted on the shaft 45. The gear 52 is driven by a drive gear 54, fixedly attached to the primary drive shaft 2 so that the flyweights 48 rotated by the gear 52 via the sheet metal pockets 51 are moved radially outward depending on the rpm, thereby lifting the control sleeve 47. Hence, when the tip of the control sleeve 47 engages the control lever 30, an rpm-dependent force is transmitted to the control lever in opposition to the force due to the control springs 41 and 37. As soon as the clockwise torque acting on the control lever 30 due to the centrifugal force exceeds the counterclockwise torque due to the forces exerted by the control springs, the annular slide 28 is moved downwardly in the direction of an earlier opening of the transverse bore 27 during the pumping stroke, i.e., it moves in the sense of reducing the injected fuel quantity. The slide 28 moves until an equilibrium of torques again prevails at the control lever 30.

The lower portion 55 of shaft 45 has a larger diameter than the upper portion 46, and it carries the gear 52 which is mounted in fixed rotation manner, for example, by means of a spline and spring and is axially secured in one direction by a snap ring 56. The lower part 55 of the shaft is borne in the housing and extends into a disc-shaped recess 58 in the pump housing in which a fuel supply pump 60 is also disposed. The recess 58 is sealingly closed by a cover 61 and forms a disc-shaped chamber. In the example shown the fuel supply pump 60 is a vane pump whose inner driven member 63 has splines 64 which engage the lower part 55 of the shaft. The driven pump member 63 is axially secured on the lower part 55 of the shaft by a safety ring 65 which also provides axial security for the shaft 45 in the second direction. The driven disc-shaped member 63 rotates eccentrically within an outer ring 66 and has radial grooves 67 in which plate-like elements 69 are disposed for radial movement.

A connecting channel 71 terminates in the region of the recess 58 lying between the inner driven member 63 and the outer ring 66 of the fuel supply pump. The channel 71 leads to the pump suction chamber 22. Diametrically opposite, but also within the region lying between the outer ring 66 and the driven member 63 lies a suction channel 72 leading to a fuel storage container 73. An overflow line 74 leads from the connecting channel 71 to a pressure control valve 76 and thence to the suction line 72 and the fuel storage container 73.

When the primary drive shaft 2 is rotated, the drive gear 54 in turn rotates the gear 52 and hence also the shaft 45. This rotation results, on the one hand, in an excursion of the flyweights 48 and a sliding motion of the control sleeve against the force of the control springs and on the other hand, it causes the rotation of the driven member 63 of the fuel supply pump. The resulting centrifugal force moves the plate-like elements 69 against the outer ring 66 so that fuel is delivered from the suction side, i.e., from the termination of the suction channel 72, to the pressure side, i.e., to the connecting channel 71. The fuel pressure in the suction chamber 22 on the delivery side of the supply pump is controlled by the pressure control valve 76 so that an rpm-dependent pressure is produced.

Of course, the vane pump illustrated in the drawing whose construction and method of operation is known could be replaced by a roller pump or a gear pump of customary construction. With the construction shown and thanks primarily to the geared drive, the fuel supply pump may be made very small because it may be driven at substantially higher rpm than the fuel injection pump itself. The assembly of the supply pump with the shaft of the centrifugal force governor provides further advantages: firstly, the fuel supply pump is easily accessible from the outside; secondly, a separate drive shaft is unnecessary in this construction and; thirdly, this disposition results in additional oscillation damping of the centrifugal force governor. The primary drive shaft 2 may have a substantially larger diameter than it has when the fuel supply pump is constructed in the customary known manner, so that its torsional rigidity is increased and the transfer of torsional oscillations to the centrifugal force governor is considerably reduced.

What is claimed is:

1. In a fuel injection pump for internal combustion engines which includes a housing, a primary drive shaft disposed to rotate in said housing, cylinder means disposed within said housing, a reciprocating and rotating pump piston moving within said cylinder means and powered by said primary drive shaft, a centrifugal force governor for regulating the injected fuel quantity, and a fuel supply pump for supplying fuel to said cylinder means for delivery by said pump piston, the improvement comprising:

a secondary shaft, disposed to rotate within said housing and driven mediately by said primary drive shaft for simultaneously powering the motion of said centrifugal force governor and said fuel supply pump; and cover means, wherein:

i. said housing has an interior recess which together with said cover means define an enclosure within which said fuel supply pump is mounted, said fuel supply pump including a central movable member;

ii. the central movable member of said fuel supply pump is coaxially disposed on one end of said secondary drive shaft;

iii. said secondary shaft comprises an upper portion and a lower portion with said lower portion having a larger diameter than said upper portion;

iv. said primary shaft includes drive imparting means; and v. said lower portion has a drive receiving means mounted thereto which engages the drive imparting means of said primary shaft for driving said secondary shaft, and a drive imparting means mounted thereto which engages and imparts a drive to said central movable member of said fuel supply pump.

2. An improved fuel injection pump as defined in claim 1, wherein said housing defines a suction chamber and a bore which opens at one end into said interior recess and at its other end into said suction chamber, and wherein the lower portion of said secondary shaft extends through said bore defining thereby two ends one of which extends into said suction chamber and has said drive receiving means mounted thereto and the other of which extends into said interior recess and has said drive imparting means mounted thereto.

3. An improved fuel injection pump as defined in claim 2, wherein said housing defines a suction channel which leads to said interior recess and a further bore which opens at one end into said interior recess and at its other end into said suction chamber, said suction channel serving for the passage of fuel to said fuel supply pump and said bore serving for the passage of fuel from said fuel supply pump to said suction chamber.

4. An improved fuel injection pump as defined in claim 3, wherein the improvement further comprises an overflow line and a pressure control valve connected to said further bore.

* * * * *